US005301378A

United States Patent [19]

Schultz

[11] Patent Number: 5,301,378

[45] Date of Patent: Apr. 12, 1994

[54] FIBERGLASS INSTALLATION TOOL

[76] Inventor: Vincent L. Schultz, 435 W. 7th Ave., Shakopee, Minn. 55379

[21] Appl. No.: 21,512

[22] Filed: Feb. 23, 1993

[51] Int. Cl.[5] ..... B25F 1/00

[52] U.S. Cl. ..... 7/158

[58] Field of Search ..... 7/158, 114, 116, 170

[56] References Cited

U.S. PATENT DOCUMENTS

| | | | |
|---|---|---|---|
| 825,063 | 7/1906 | Lawbaugh | 7/158 |
| 832,455 | 10/1906 | Christensen . | |
| 2,316,446 | 4/1943 | Matsunaga | 97/71.1 |
| 2,559,689 | 7/1951 | Truesdell | 30/162 |
| 2,907,106 | 10/1959 | Lockwood | 7/158 |
| 2,948,960 | 8/1960 | Eckstein | 7/158 |
| 3,157,946 | 11/1964 | Smecko | 30/169 |
| 3,219,316 | 11/1965 | Fried | 7/158 |
| 5,063,627 | 11/1991 | Marra | 7/105 |

*Primary Examiner*—Roscoe V. Parker

*Attorney, Agent, or Firm*—Palmatier, Sjoquist & Helget

[57] ABSTRACT

This disclosure relates to a tool for use in the installation of rock wool or fiberglass insulation in residential and commercial buildings. The tool includes first and second tubular body members affixed to each other in an adjustable and telescoping relationship, a paddle member affixed to the first tubular body member, a blade member affixed to the second tubular body member, and a spring actuated tubular safety sheath covering the blade member during use of the rock wool or fiberglass installation tool. The adjustable length of the tool permits enhanced flexibility during the installation of rock wool or fiberglass insulation. The paddle and blade members provide increased utility and convenience to workmen, and the spring actuated safety sheath minimizes the risk of injuries to individuals during use of the tool.

26 Claims, 1 Drawing Sheet

36
34
42
12
16
10
48
50
28
36
26
24
24
20
58
46
72
14
74
56
18

70
18
90
54
52
68
66
44
59
60
64
50
56
61
18
74
72
62
46
48

72
74
80
86
18
84

78
80
72
30
28
30
28
82
28
76
76
28

14
26
42
28
40
16
34
28

FIBERGLASS INSTALLATION TOOL

BACKGROUND OF THE INVENTION

Rock wool is a fibrous insulating material made by blowing steam through molten siliceous rock which gives the rock wool the appearance of spun glass. Fiberglass insulation may be spun from glass. Workmen frequently install rock wool or fiberglass insulation in residential or commercial buildings. Workmen are frequently required to carry a variety of tools to aid in the installation of rock wool or fiberglass insulation. These tools include, but are not limited to, paddles such as putty knives, and cutting members or knives. Installers of rock wool or fiberglass insulation require a flexible tool for use in a variety of locations and/or conditions. A tool having an adjustable length is highly desirable. In addition, workmen frequently need a single tool having features of a paddle and a cutting member. Finally, workmen frequently require a tool providing convenient safety features during and following the cutting of rock wool or fiberglass insulation. No single tool as known exists to solve these problems which satisfy the particular needs of a workman during the installation of rock wool or fiberglass insulation in residential and/or commercial buildings. The invention described herein overcomes these identified problems.

SUMMARY OF THE INVENTION

This invention relates to a tool for use in the installation of rock wool or fiberglass insulation in residential and commercial buildings. The invention includes first and second tubular body members affixed to each other in an adjustable and telescoping relationship, a paddle member affixed to the first tubular body member, a blade member affixed to the second tubular body member, and a spring actuated tubular safety sheath covering the blade member during use of the rock wool or fiberglass installation tool. The adjustable length of the tool permits enhanced flexibility during the installation of rock wool or fiberglass insulation. The paddle and blade members provide increased utility and convenience to workmen, and the spring actuated safety sheath minimizes the risk of injuries to individuals during use of the tool.

It is a principal object of the present invention to provide a new and improved rock wool or fiberglass installation tool of relatively simple and inexpensive design, construction, and operation which is safe and durable and which fulfills the intended purpose without injury to persons and/or damage to property.

Another object of the present invention is to provide a flexible tool which may be easily manipulated by an individual for use in a variety of operational conditions.

Still another object of the present invention is to provide a tool which is safe and will minimize the risk of injury to a workman resulting from cuts which may occur following exposure of the cutting member.

Still another object of the present invention is to provide a rock wool or fiberglass installation tool of sturdy and lightweight construction which will not fracture, bend, or break during use.

Still another object of the present invention is to provide a rock wool or fiberglass installation tool having easily replaceable features such as paddle members and blade members.

A feature of the present invention includes a first tubular body member in telescoping relationship to a second tubular body member for adjustment of the length of the invention for satisfaction of environmental restrictions or individual requirements of a workman.

Another feature of the present invention includes a replaceable paddle member affixed to a paddle base, which in turn is affixed to one end of the invention, for installation of rock wool or fiberglass insulation between joists and/or studs of a building.

Still another feature of the present invention includes a blade base having a blade guide affixed to the opposite end of the invention.

Still another feature of the present invention includes a replaceable blade member having a cutting edge engaged to the blade guide for cutting of rock wool or fiberglass insulation to a desired length.

Still another feature of the present invention includes a spring actuated tubular safety sheath for retractable manipulation by an individual for exposure of the blade member, where the safety sheath returns to a covering position over the blade member upon release of the safety sheath by an individual.

DETAILED SPECIFICATION OF THE PREFERRED EMBODIMENT

Figure 1:
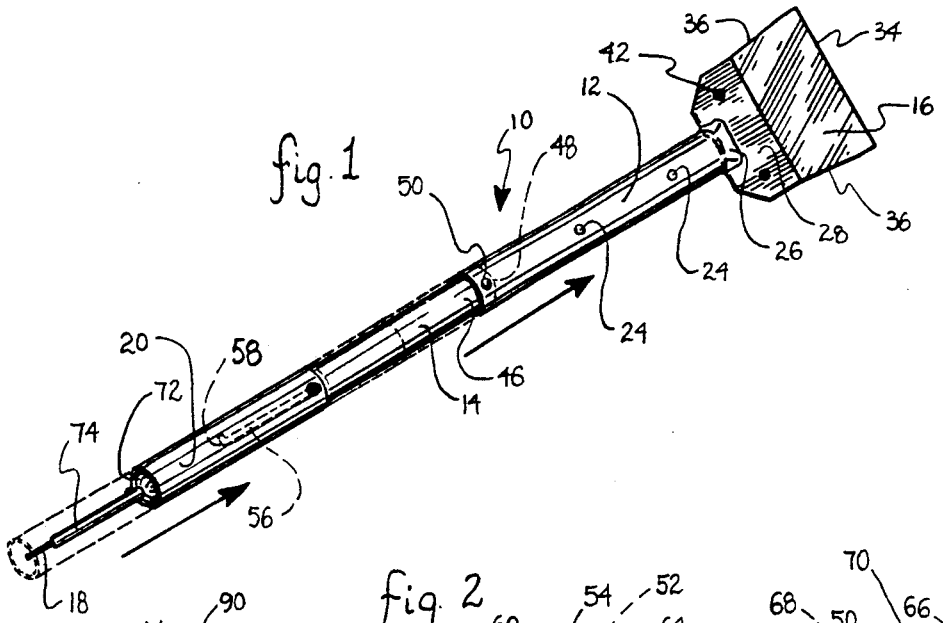
FIG. 1 is an isometric partially phantom line view of the invention.

One form of the invention is illustrated and described herein. The rock wool or fiberglass installation tool is illustrated in general by the numeral 10. Generally, the rock wool or fiberglass installation tool 10 includes a first tubular body member 12, a second tubular body member 14, a paddle member 16, a blade member 18, and a safety sheath 20. (FIG. 1)

The first tubular body member 12 has a circular cross section. The first tubular body member 12 may have a square, rectangular, elliptical, or oval cross section at the preference of an individual. The first tubular body member 12 is preferably formed of stamped aluminum metal material. The first tubular body member 12 may be formed of any preferred metal or rigid plastic material so long as the rock wool or fiberglass installation tool 10 does not fracture, break or bend during the installation of rock wool or fiberglass insulation.

Preferably, the first tubular body member 12 has length and diameter dimensions of 8-½ inches and 1 inch, respectively. The first tubular body member 12 may have a length dimension between 5-½ inches and 11-½ inches. The length of the first tubular body member 12 may be shorter or longer dependent upon the environmental conditions encountered by a workman during installation of rock wool or fiberglass insulation. The first tubular body member 12 has a plurality of aligned and regularly spaced apertures 24. (FIG. 1) The apertures 24 extend longitudinally along the length of the first tubular body member 12. The apertures 24 are preferably spaced three inches apart. The apertures 24 are regularly spaced for adjustment of the length of the rock wool or fiberglass installation tool 10. The spacing of the apertures 24 may be shortened or increased at the preference of an individual. The purpose of the apertures 24 is to provide flexibility to an individual by providing alternative positions for expansion or shortening of the length of the rock wool or fiberglass installation tool 10. The purpose of the first tubular body member 12 is to provide for the receiving engagement of the second tubular body member 14.

A paddle base 26 is preferably affixed to one end of the first tubular body member 12. (FIGS. I and 5) The paddle base 26 is preferably formed of aluminum metal material; however, the paddle base 26 may be formed of any preferred metal or rigid plastic material so long as the paddle base 26 does not fracture, bend or break during use of the rock wool or fiberglass installation tool 10. The paddle base 26 may be affixed to the first tubular body member 12 by any conventional means including but not limited to welding, adhesives, soldering, screws, molding, rivets, and/or nuts and bolts.

The paddle base 26 contains a pair of side walls 28 extending longitudinally outward therefrom. (FIGS. 1 and 5) The pair of side walls 28 are spaced apart from each other defining a paddle slot 30. Each of the pair of side walls 28 are preferably 4-½ inches in width and four inches in height. One of the pair of side walls 28 has a pair of second apertures. Preferably, the second apertures are positioned adjacent the paddle base 26. The second apertures are also preferably spaced equal distances outwardly from the center of one of the side walls 28. The pair of side walls 28 affix the paddle member 16 to the paddle base 26 and the first tubular body member 12. Both of the side walls 28 may have aligned second apertures at the discretion of an individual.

Figure 5:
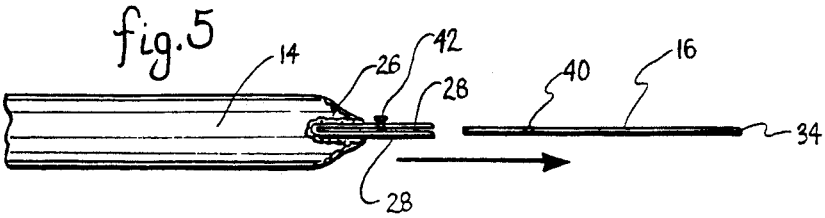
FIG. 5 is a side view of the paddle member.

The paddle member 16 is preferably formed of flexible steel or spring steel having a gauge thickness of at least 40/1000 inches. The paddle member 16 may be formed of flexible steel or spring steel having an increased gauge of thickness at the preference of an individual. The paddle member 16 has a front edge 34 having a length dimension of four inches. The paddle member 16 also has a pair of side edges 36 having a length dimension equal to five inches. The paddle member 16 is substantially rectangular in shape. The rear edge 38 is seated in the paddle slot 30 for attachment to the pair of side walls 28 of the paddle base 26. (FIGS. 1 and 5)

The paddle member 16 has a pair of third apertures 40 positioned proximal to the rear edge 38. (FIG. 5) The third apertures 40 are aligned with the second apertures of one of the pair of side walls 28. The third apertures 40 are spaced outwardly equal distances from the center of the paddle member 16.

The paddle member 16 provides to an individual a resiliently flexible flat surface for use in the installation of rock wool or fiberglass insulation. An individual may substitute any resiliently flexible metal for the preferred material indicated so long as the material chosen does not fracture and/or break during use of the rock wool or fiberglass installation tool 10.

The paddle attachment means 42 affixes the paddle member 16 to the paddle base 26. The paddle attachment means 42 passes through the second apertures of one of the pair of side walls 28 and the third apertures 40 through the rear edge 38 of the paddle member 16 securely affixing the rear edge 38 in the paddle slot 30. The preferred paddle attachment means 42 are screws; however, any preferred means for engagement may be used, including but not limited to, nuts and bolts, provided that the paddle attachment means 42 may be released for replacement of a paddle member 16 at the discretion of an individual. The tightening of the paddle attachment means 42 preferably results in the flush, continuous, rigid and tight engagement of the pair of side walls 28 to the paddle member 16. The flush, continuous, and rigid engagement between the paddle member 16 and the pair of side walls 28 provides support to the paddle member 16 during installation of the rock wool or fiberglass insulation.

During installation of rock wool or fiberglass insulation, the front edge 34 of the paddle member 16 is preferably aligned perpendicular to the studs and/or joists of a building, and is used to apply pressure to force the rock wool or fiberglass insulation into the areas between the joists and/or studs. The exertion of pressure upon the paddle member 16, perpendicularly to the front edge 34, necessitates a secure and durable engagement between the paddle base 26 and the paddle member 16.

The paddle attachment means 42 provides flexibility to an individual for the convenient replacement of the paddle member 16 following wear.

The second tubular body member 14 has a circular cross section. The second tubular body member 14 may have a square, rectangular, elliptical, or oval cross section at the preference of an individual. Second tubular body member 14 is preferably formed of stamped aluminum metal material. The second tubular body member 14 may be formed of any preferred metal or rigid plastic material so long as the rock wool or fiberglass installation tool 10 does not fracture, bend, or break during use.

Preferably, the second tubular body member 14 has a length and diameter dimensions equal to twelve inches and ⅛ inch, respectively. The second tubular body member 14 may have a length dimension between nine and fifteen inches. The length of the second tubular body member 14 may be shorter or longer dependent upon the operational conditions for use of the tool 10 during installation of rock wool or fiberglass insulation.

Figure 2:
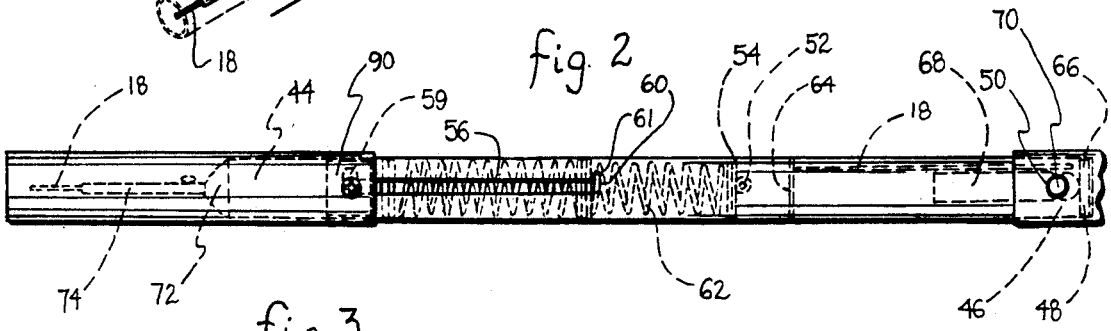
FIG. 2 is a detailed partially phantom line view of the second tubular body member, cutting member, and safety sheath.

The second tubular body member 14 has a first exterior end 44 and a second interior end 46. The second interior end 46 has a first edge 48. The second interior end 46 also has a first aperture 50 proximal to the first edge 48. The second tubular body member 14 is of a smaller diameter than the first tubular body member 12. (FIG. 2)

The second tubular body member 14 has an interior which is traversed by a spring stop 52. The spring stop 52 is centrally positioned between the first exterior end 44 and the second interior end 46. The spring stop 52 may be affixed to the second tubular body member 14 by any preferred means including but not limited to welding, the use of screws, nuts and bolts, rivets, adhesives, and/or molding. The spring stop 52 may also be seated upon an interior ledge at the discretion of an individual. Preferably a washer 54 is flushly engaged and adjacent to the spring stop 52 between the spring stop 52 and the first exterior end 44 of the second tubular body member 14. (FIG. 2)

A guide groove 56 extends longitudinally along the first exterior end 44 through the second tubular body member 14. The guide groove 56 does not traverse the first exterior end 44. The guide groove 56 has a first proximal end 58 positioned adjacent to the first exterior end 44 and a second distal end 60 positioned proximal to the spring stop 52. The guide groove 56 is spaced approximately equal distances between the spring stop 52 and the first exterior end 44. (FIG. 2) A safety lock groove 59 extends outwardly from the guide groove 56 proximal to the first exterior end 44. A rear ledge 61 extends outwardly from guide groove 56 proximal to the spring stop 52.

A spring 62 is located inside the second tubular body member 14 between the spring stop 52, and washer 54, and the first proximal end 58 of the guide groove 56. (FIG. 2)

A blade stop 64 is affixed to, and preferably traverses the interior of the second tubular body member 14, equal distances between the second interior end 46 and the spring stop 52. The blade stop 64 may be a washer, ledge, pin, screen, or plug at the discretion of an individual. The purpose of the blade stop 64 is to prevent replacement blade members 16 from sliding within the interior of the second tubular body member 14 to a location which is inconvenient or inaccessible for retrieval purposes. (FIG. 2)

A plug and/or cap 66 fits within or covers the second interior end 46 of the second tubular body member 14. The plug and/or cap maintains replacement blade members 18 inside the second tubular body member 14 between the plug and/or cap 66 and the blade stop 64. Replacement blade members 18 are therefore maintained in a fixed and convenient location for retrieval and replacement purposes during use of the rock wool or fiberglass installation tool 10. (FIG. 2)

The sliding and receiving engagement between the second tubular body member 14, and the first tubular body member 12, establishes a telescoping relationship between the two units for adjustment of the length of the rock wool or fiberglass installation tool 10.

The purpose of the spring stop 52 is to position the spring 62 proximal to the first exterior end 44 of the second tubular body member 14. The purpose of the spring 62 is to provide actuating movement of the safety sheath 20 between a covering position and a retracted position over the blade member 18. Another purpose of the spring 62 is to provide actuating movement of the safety sheath 20 into a covering position over the blade member 18 upon the involuntary or inadvertent release of the safety sheath by an individual. The purpose of the guide groove 56 is to establish a structurally integral path for the sliding engagement of the safety sheath 20 into a retracted or covering position over the blade member 18. (FIG. 2) The purpose of the safety lock 59 is provide to an individual a means for fixing the safety sheath 20 in a covering position over the blade member 18 during use of the rock wool or fiberglass installation tool 10. An individual may rotate the safety sheath 20 for engagement of the safety stop 90 to the safety lock groove 59 to affix the safety sheath 20 in a covering position over the blade member 18. Rotation of the safety sheath 20 in an opposite direction disengages the safety stop 90 from the safety lock groove 59 permitting an individual to retract the safety sheath 20. The purpose of the rear ledge 61 is to provide a means for assisting an individual in retaining the safety sheath 20 in a retracted position during exposure of the blade member 18, where the means is integral to the second tubular body member 14. It should be noted that the rear ledge 61 does not permit an individual to affix the safety sheath in a retracted position when exposing the blade member 18. The rear ledge 61 does provide mechanical support to an individual in retracting the safety sheath 20 during exposure of the blade member 18. The rear ledge 61 extends outwardly from the guide groove 56 approximately one-eighth inch. The safety sheath 20 may be rotated for engagement between the safety stop 90 and the rear ledge 61 during exposure of the blade member 18.

An attachment means 68 is located inside the second interior end 46 of the second tubular body member 14. The attachment means 68 is preferably a spring clip; however, the attachment means 68 may be any suitable means for releasably engaging the second tubular body member 14 to the first tubular body member 12, including but not limited to, latches, clips, and/or snaps. The attachment means 68 has a knob 70 which passes through the first aperture 50 of the second tubular body member 14 and one of the plurality of aligned apertures 24 of the first tubular body member 12. The attachment means 68 permits the releasable engagement between the first and second tubular body members 12, 14 for adjustment of the length of the rock wool or fiberglass installation tool 10. The attachment means 68 is preferably affixed to the interior of the second interior end 46 by any preferred means including but not limited to solder, adhesives, rivets and/or welding. (FIGS. 1 and 2)

The length of the rock wool or fiberglass installation tool 10 may be adjusted by depression of the knob 70 downward from one of the plurality of aligned apertures 24, and rotation of the first and second tubular body members 12, 14, such that the knob 70 is manipulated for engagement to the interior of the first tubular body member 12. The length of the rock wool or fiberglass installation tool 10 may then be either shortened or expanded at the discretion of an individual. Fixed engagement between the first and second tubular body members 12, 14 may then occur by reverse rotation of the first and second tubular body members 12, 14 and alignment of the knob 70 to one of the plurality of aligned apertures 24. It should be noted that the plurality of aligned apertures 24 and the first aperture 50 are of a sufficient size to permit passing engagement of the knob 70 without excessive space between the knob 70 and the walls of the apertures 24 and 50. The attachment means 68 is preferably compressed, such that the attachment means 68 expands upon alignment of the knob 70 with the first aperture 50. In addition, the attachment means 68 actuates the knob 70 outwardly from the second tubular body member 14 upon alignment of the first aperture 50 to one of the plurality of aligned apertures 24 of the first tubular body member 12.

Figure 3:
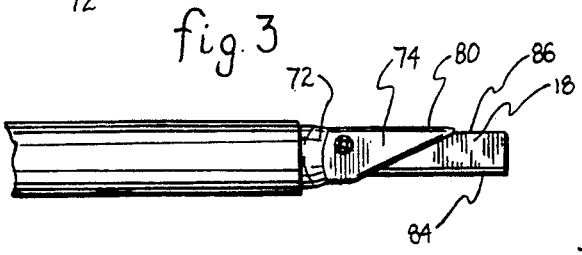
FIG. 3 is a detailed view of the cutting member.
Figure 4:
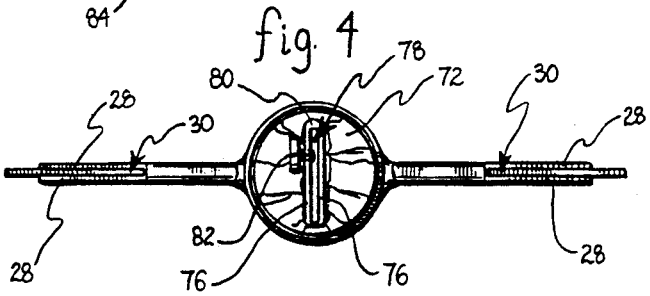
FIG. 4 is an end view of the invention.

A blade base 72 is preferably affixed to the second exterior end 46 of the second tubular body member 14. The blade base 72 is preferably formed of aluminum metal material; however, the blade base 72 may be formed of any preferred metal or rigid plastic materials so long as the blade base 72 does not fracture, bend, or break during use of the rock wool or fiberglass installation tool 10. The blade base 72 may be affixed to the second exterior end 46 by any conventional means including but not limited to welding, adhesives, soldering, screws, molding, rivets, and/or nuts and bolts. (FIGS. 3 and 4)

The blade base 72 is preferably dome shaped; however, the blade base 72 may be flat at the discretion of an individual. The shape of the blade base 72 is not critical to operation of the rock wool or fiberglass installation tool 10 so long as the blade base 72 provides adequate support for the blade member 18 during cutting of rock wool or fiberglass. (FIGS. 3 and 4)

A blade guide 74 is preferably affixed to the blade base 72 extending longitudinally forward therefrom.

The blade guide 74 is preferably formed of aluminum metal material; however, the blade guide 74 may be formed of any preferred metal or rigid plastic material so long as the blade guide 74 does not fracture, bend or break during use of the blade member 18. The blade guide 74 may be affixed to the blade base 72 by any convention means including but not limited to welding, adhesives, soldering, screws, molding, rivets and/or nuts and bolts. (FIGS. 3 and 4)

The blade guide 74 generally has dimensions of length equal to 2 inches, width equal to ¼ inches, and height equal to 1 inch. The blade guide 74 preferably has a pair of triangularly shaped support walls 76 and a base 80. The pair of support walls 76 define a blade slot 78. The blade slot 78 is generally two inches in length. (FIGS. 3 and 4)

One of the support walls 76 preferably has a fourth aperture 82 therethrough. (FIG. 4) The fourth aperture 82 through one of the support walls 76 is preferably positioned proximal to the blade base 72 which in turn is proximal to the base 80 of the blade guide 74. (FIG. 3) The purpose of the fourth aperture 82 is to securely fasten the blade member 18 to the blade guide 74. Another purpose of the fourth aperture 82 and blade guide 74 is to prevent the axial twisting of the blade member 18 during cutting of rock wool or fiberglass insulation. Still another purpose of the fourth aperture 82, through one of the pair of support walls 76, is to provide for the convenient replacement of a blade member 18 following wear resulting from the cutting of rock wool or fiberglass insulation. (FIG. 3 and 4)

The blade member 18 is preferably rectangular in shape and is formed of tempered carbon metal material. The blade member 18 has a sharpened cutting edge 84 adapted for the cutting of fibrous rock wool or fiberglass material. The blade member 18 is preferably 4 inches in length and ½ inch in height. The dimensions, shape, and material of the blade member 18 may be suitably varied at the discretion of an individual provided the attributes and features as described herein are not sacrificed. (FIG. 3)

The blade member 18 has a lower edge 86 which is flushly engaged to the base 80 of the blade guide 74. (FIG. 3) The blade member 18 has a fifth aperture located proximal to the lower edge 86 adjacent one of the ends. The fifth aperture of the blade member 18 is aligned with the aperture 82 of one of the support walls 76. The blade member 18 is securely affixed to the blade guide 74 by a screw. The blade member 18 may, however, be affixed to the blade guide 74 by any preferred means, such as a nut and bolt, provided that the blade member 18 may be easily replaced at the discretion of an individual. The tightening of the screw preferably results in the flush, continuous, and tight engagement of the blade member 18 to the pair of support walls 76. The flush, continuous, and tight engagement between the support walls 76 and the blade member 18 provides support to the blade member 18 during cutting of rock wool or fiberglass insulation. During the cutting of rock wool or fiberglass insulation, the base 80 of the blade guide 74 also provides support to the blade member 18. The base 80, and pair of support walls 76 of the blade guide 74 prevent the axial twisting of the blade member 18 during use of the tool 10 while cutting rock wool or fiberglass insulation. (FIGS. 3 and 4)

The purpose of the blade member 18 is cut rock wool or fiberglass insulation to a desired length for positioning rock wool or fiberglass insulation between studs and/or joists of a building. It should be noted that the blade member 18 is positioned perpendicular to the paddle member 16. During use of the blade member 18, the first and second tubular body members 12, 14 may be positioned proximal to, and/or in flush contact to the underside of an individual's forearm. The paddle member 16 is therefore in contact with the elbow, or the portion of the arm proximal to the elbow. The perpendicular alignment of the blade member 18 and the paddle member 16 eliminates inconvenient interference of the paddle member 16 and an individual's arm during use of the blade member 18.

The safety sheath 20 is tubular having a circular cross section. The safety sheath 20 may have a square, rectangular, elliptical, and/or oval cross section at the preference of an individual. The safety sheath 20 is preferably formed of stamped aluminum metal material. The safety sheath 20 may be formed of any preferred metal or rigid plastic material so long as the rock wool or fiberglass installation tool 10 does not fracture, break or bend during use for its intended purpose.

Preferably the safety sheath 20 has length and diameter dimensions of eight inches and one inch, respectively. The length dimension of the safety sheath 20 may be increased or decreased at the preference of an individual so long as the safety sheath 20 completely covers the blade member 18 when the safety sheath 20 has not been manipulated into a retracted position. Preferably, the safety sheath 20 extends from a position beyond the blade member 18 to a position over the first exterior end 44 and the first proximal end 58 of the guide grooves 56 of the second tubular body member 14. (FIGS. 1 and 2)

The safety sheath 20 has a safety stop 90 which is located inside the second tubular body member 14. The safety stop 90 is positioned proximal to the first exterior end 44. The safety stop 90 may be affixed to the safety sheath 20 by any preferred means including but not limited to welding, the use of screws, nuts and bolts, rivets, adhesives, and/or molding. The safety stop 90 may be a pin and/or interior tubular collar at the discretion of an individual. In the preferred embodiment, the safety stop 90 is an interior tubular collar located inside the second tubular body member 14. The safety stop 90 is affixed to the safety sheath 20 by a screw. The screw affixing the safety stop 90 to the safety sheath 20 passes through a sixth aperture through the safety sheath 20, and through the longitudinally extending guide groove 56 of the second tubular body member 14. The safety stop 90 is forward of, and exterior to, the spring 62. The spring 62 is thereby positioned between and confined by the safety stop 90 and the spring stop 52 inside of the first exterior end 44 of the second tubular body member 14. A second washer may be placed between the spring 62 and the safety stop 90 at the discretion of an individual. (FIG. 2)

In operation, the expansion of the spring 62 maintains actuating outward pressure on the safety stop 90 and the spring stop 52 causing the outward movement of the safety sheath 20 away form the second tubular body member 14 into a covering position over the blade member 18. (FIG. 2) The safety sheath 20 then minimizes risk of injury to an individual due to inadvertent or accidental cutting which may occur from contact with the blade member 18.

An individual may expose the blade member 18 for cutting rock wool or fiberglass insulation by grasping the safety sheath 20 and sliding the safety sheath 20 rearwardly toward the second tubular body member 14. (FIG. I) The reward movement of the safety sheath 20, engaged to the safety stop 90, is confined to a path defined by the longitudinally extending guide groove 56. The retracted position for the safety sheath 20 is established at the distal end 60 of the longitudinally extending guide groove 56. The movement of the safety sheath 20 in a rearward direction causes the safety stop 90 to coil the spring 62 into a compressed configuration. An individual is required to continuously exert force or pressure upon the safety sheath 20 in order to maintain the safety sheath 20 in a retracted position. It should be noted that the mechanical feature of the rear ledge 61 assists an individual in retaining the safety sheath 20 in a retracted position by engagement of the safety stop 90 the rear ledge 61. Upon the inadvertent or intentional termination of retractable force to the safety sheath 20, the spring 62 uncoils, automatically actuating the safety stop 90, causing the safety sheath 20 to move into a static covering relationship over the blade member 18. An individual is required to consciously maintain the safety sheath 20 in a retracted position during exposure of the blade member 18 for cutting of rock wool or fiberglass insulation. (FIGS. 1 and 2)

The adjustable length of the insulation tool 10 significantly improves the ease of installation of rock wool or fiberglass insulation to an individual. A workman, by use of the installation tool 10, is provided with the ability to insert rock wool or fiberglass insulation into spaces/areas which were previously out of reach to the individual. The safety sheath 20 significantly improves the safety to an individual by minimizing the risk of accidental cuts and/or injuries which may result upon contact with the blade member 18.

The present invention may be embodied in other specific forms without departing from the spirit or essential attributes thereof; therefore, the illustrated embodiment should be considered in all respects as illustrative and not restrictive, reference being made to the appended claims rather than to the foregoing description to indicate the scope of the invention.

What is claimed:

1. A rock wool or fiberglass installation tool comprising:

(a) a first tubular body member having a plurality of aligned apertures therethrough, an interior, and two ends;

(b) a paddle base affixed to one end of said first tubular body member;

(c) a paddle member affixed to said paddle base;

(d) a second tubular body member having an interior and first and second ends, said second end having a first aperture therethrough, said second tubular body member further having a spring stop traversing said interior, said second tubular body member further having a longitudinally extending guide groove proximal to said first end, said second tubular body member further having a spring positioned in said interior between said spring stop and said first end, said second end of said second tubular body member positioned inside said first tubular body member;

(e) an attachment means affixed to said interior of said second tubular body member proximal to said second end, said attachment means passing through said first aperture of said second end of said second tubular body member and one of said plurality of aligned apertures of said first tubular body member, said attachment means releasably affixing said second tubular body member to said first tubular body member;

(f) a blade base fixed to said first end of said second tubular body member;

(g) a blade member affixed to said blade base; and (h) a retractable tubular safety sheath covering said blade member, said tubular safety sheath having a safety stop engaged to said guide groove, said safety stop further positioned adjacent to said spring confining said spring between said spring stop and said safety stop inside of said second tubular body member.

2. The tool according to claim 1, wherein said paddle base further comprises a pair of side walls defining a paddle slot, one of said side walls having a pair of second apertures therethrough.

3. The tool according to claim 2, wherein said paddle member further comprises a forward edge, two side edges, and a rear edge, said rear edge affixed to said paddle slot, said rear edge having a pair of third apertures therethrough.

4. The tool according to claim 3, wherein a paddle attachment means passes through each of said second apertures of said pair of side walls and said third apertures through said rear edge of said paddle member, said paddle attachment means affixing said paddle member to said paddle base.

5. The tool of according to claim 4, wherein said second tubular body member further comprises a blade stop affixed to and traversing said interior between said second end said spring stop.

6. The tool according to claim 5, wherein said second tubular body member further comprises a plug engaged to said second end.

7. The tool according to claim 6, wherein said attachment means further comprise a spring clip having a knob, said knob passing through said first aperture of said second end of said second tubular body member and one of said plurality of aligned apertures of said first tubular body member, where said knob releasably attaches said second tubular body member to said first tubular body member.

8. The tool according to claim 7, wherein said blade base further comprises a blade guide having a pair of support walls defining a blade slot, said blade guide having a fourth aperture through one of said support walls.

9. The tool according to claim 8, wherein said blade member has a cutting edge and a fifth aperture therethrough, said blade member seated in said blade slot of said blade guide.

10. The tool according to claim 9, wherein said tubular safety sheath further comprises an interior, a first end having a sixth aperture therethrough, and an attachment means passing through said sixth aperture engaged to said safety stop.

11. The tool according to claim 10, wherein said paddle member is removably affixed to said paddle base.

12. The tool according to claim 10, wherein said paddle member is formed of resiliently flexible spring steel.

13. The tool according to claim 10, wherein said second tubular body member further comprises a ledge supporting said spring stop.

14. The tool according to claim 10, wherein said spring stop is centrally positioned between said second end and said first end of said second tubular body member.

15. The tool according to claim 10, wherein said guide groove is centrally positioned between said first end and said spring stop of said second tubular body member.

16. The tool according to claim 10, wherein said spring is positioned inside of said second tubular body member between said spring stop and said safety stop.

17. The tool according to claim 10, wherein said plug is removably engaged to said second end of said second tubular body member.

18. The tool according to claim 10, wherein a portion of said second tubular body member is positioned inside said first tubular body member for adjustable telescopic extension therefrom.

19. The tool according to claim 10, wherein said blade member is replaceable and is affixed to said blade guide by a screw passing through said fourth aperture and said fifth aperture.

20. The tool according to claim 10, wherein said cutting edge of said blade member is perpendicular to said paddle member.

21. The tool according to claim 10, wherein said blade guide and said blade slot extend longitudinally forwardly from said blade base supporting said blade member during cutting of rock wool or fiberglass insulation.

22. The tool according to claim 10, wherein said safety sheath is slidably mounted to said second tubular body member covering said blade member, where said safety sheath is slidable rearwardly toward said paddle member for exposing said cutting member during cutting of rock wool or fiberglass insulation.

23. The tool according to claim 22, wherein said spring is coiled during retraction of said safety sheath for exposure of said blade member.

24. The tool according to claim 23, wherein said spring uncoils and returns said safety sheath to a covering position over said blade member upon inadvertent or intentional release of said safety sheath by an individual.

25. The tool according to claim 1, wherein said longitudinally extending guide groove comprises opposite ends where one of said opposite ends has a safety lock groove and said other end has a rear ledge.

26. A rock wool or fiberglass installation tool comprising:

(a) a first tubular body member having an interior and a plurality of longitudinally aligned apertures therethrough, said first tubular body member further having two ends;

(b) a paddle base affixed to one end of said first tubular body member, said paddle base having a pair of side walls defining a paddle slot and a pair of second apertures through one of said pair of side walls;

(c) a paddle member having a forward edge, two side edges, and a rear edge, said rear edge affixed to said paddle slot, said rear edge having a pair of third apertures therethrough;

(d) paddle attachment means passing through each of said second apertures and said third apertures affixing said paddle member to said paddle base;

(e) a second tubular body member having a first end, a second end having a first aperture therethrough, and an interior, said second tubular body member further having a spring stop affixed to and traversing said interior, said second tubular body member further having a longitudinally extending guide groove proximal to said first end, said longitudinally extending guide groove having opposite ends where one of said ends has a safety lock groove and said other end has a rear ledge, said second tubular body member further having a spring positioned in said interior between said spring stop and said first end, said second tubular body member further having a blade stop affixed to and traversing said interior between said second end and said spring stop, and said second tubular body member having a plug engaged to said second end, said second end of said second tubular body member positioned inside said first tubular body member;

(f) an attachment means having a knob engaged to the interior of said second end of said second tubular body member, said knob passing through said first aperture, said knob further passing through one of said plurality of longitudinally aligned apertures of said first tubular body member affixing said first and second tubular body members to each other;

(g) a blade base affixed to said first end of said second tubular body member, a blade guide affixed to said blade base, said blade guide having a pair of support walls defining a blade slot, one of said support walls having a fourth aperture therethrough;

(h) a blade member having a fifth aperture therethrough and a cutting edge, said blade member seated in said blade slot of said blade guide; and (i) a tubular safety sheath covering said blade member, said safety sheath having a first end having a sixth aperture therethrough, said safety sheath further having a safety stop engaged to said guide groove, said first end, and said sixth aperture, said safety stop further positioned forward and exterior to said spring maintaining said spring between said spring stop and said safety stop inside of said first end of second tubular body member.

* * * * *